US007905073B2

(12) United States Patent
Brandes et al.

(10) Patent No.: US 7,905,073 B2
(45) Date of Patent: Mar. 15, 2011

(54) METHOD AND APPARATUS FOR ASSEMBLING STRONG, LIGHTWEIGHT THERMAL PANEL AND INSULATED BUILDING STRUCTURE

(75) Inventors: Donald J. Brandes, Phoenix, AZ (US); James L. Beavers, Prescott, AZ (US)

(73) Assignee: Global Building Systems, Inc., Prescott, AZ (US)

( * ) Notice: Subject to any disclaimer, the term of this patent is extended or adjusted under 35 U.S.C. 154(b) by 31 days.

(21) Appl. No.: 12/018,791

(22) Filed: Jan. 23, 2008

(65) Prior Publication Data

US 2008/0115450 A1 May 22, 2008

Related U.S. Application Data

(63) Continuation of application No. 10/875,708, filed on Jun. 24, 2004, now abandoned.

(51) Int. Cl.
*E04C 3/04* (2006.01)
*E04C 3/08* (2006.01)

(52) U.S. Cl. ..... 52/838; 52/837; 52/636; 52/242; 52/634

(58) Field of Classification Search ..... 52/309.8, 52/309.13, 309.7, 309.14, 309.16, 481.1, 52/407.3, 764, 762, 837, 838, 241, 242, 650.1, 52/634, 636
See application file for complete search history.

(56) References Cited

U.S. PATENT DOCUMENTS

| | | | | |
|---|---|---|---|---|
| 999,752 | A | | 8/1911 | Connell |
| 1,457,303 | A | | 6/1923 | Higgins |
| 1,661,128 | A | | 2/1928 | Mankedick |
| 2,088,781 | A | * | 8/1937 | Folsom ..... 52/634 |
| 2,585,082 | A | | 2/1952 | Bollinger |
| 2,793,805 | A | | 5/1957 | Stelzer et al. |
| 3,039,232 | A | | 6/1962 | Dunn |
| 3,271,920 | A | | 9/1966 | Downing |
| 3,344,572 | A | * | 10/1967 | James Sell George ..... 52/426 |
| 3,353,315 | A | | 11/1967 | Barker |
| 3,381,439 | A | * | 5/1968 | Thulin, Jr ..... 52/842 |
| 3,479,779 | A | | 11/1969 | Ziegler |
| 3,736,715 | A | | 6/1973 | Krumwiede |
| 3,748,998 | A | | 7/1973 | Lambert |
| 3,839,839 | A | | 10/1974 | Tillisch et al. |
| 3,940,899 | A | * | 3/1976 | Balinski ..... 52/481.1 |
| 4,047,355 | A | | 9/1977 | Knorr |
| 4,152,873 | A | * | 5/1979 | Burke ..... 52/1 |
| 4,288,962 | A | | 9/1981 | Kavanaugh |
| 4,324,082 | A | | 4/1982 | Rutkowski et al. |
| 4,353,192 | A | | 10/1982 | Pearson |
| 4,435,936 | A | * | 3/1984 | Rutkowski ..... 52/481.1 |
| 4,641,468 | A | | 2/1987 | Slater |
| 4,793,113 | A | * | 12/1988 | Bodnar ..... 52/481.1 |
| 4,866,899 | A | | 9/1989 | Houser |
| 4,905,440 | A | | 3/1990 | Schilger |
| 4,930,278 | A | | 6/1990 | Staresina et al. |
| 4,970,838 | A | | 11/1990 | Phillips |

(Continued)

*Primary Examiner* — Phi Dieu Tran A

(74) *Attorney, Agent, or Firm* — Robert D. Atkins; Patent Law Group

(57) ABSTRACT

A structural panel for a building structure includes first and second stud members each including a neck. Openings and venturi bridges are formed in the neck. At least one flange is attached to the neck. A foam panel extends between the studs. The openings in the neck limit the heat transferred from the stud to the edge of the foam panel. The venturi bridges in the neck also limit the transfer of heat from the neck to the edge of the foam panel.

22 Claims, 15 Drawing Sheets

U.S. PATENT DOCUMENTS 5,033,248 A 7/1991 Phillips
5,094,052 A * 3/1992 Gudmundsson et al. .... 52/238.1
5,274,971 A 1/1994 Elmore et al.
5,285,615 A 2/1994 Gilmour
5,335,472 A * 8/1994 Phillips ..... 52/742.14
5,353,560 A 10/1994 Heydon
5,515,659 A 5/1996 MacDonald et al.
5,524,400 A 6/1996 Schmechel
5,527,625 A 6/1996 Bodnar
5,799,462 A 9/1998 McKinney
6,112,489 A 9/2000 Zweig
6,145,257 A * 11/2000 Cappuccio ..... 52/220.2
6,185,891 B1 2/2001 Moore
6,284,389 B1 9/2001 Jones et al.
6,321,505 B1 11/2001 Packman et al.
6,401,417 B1 6/2002 Leblang
6,519,904 B1 * 2/2003 Phillips ..... 52/309.12
6,708,459 B2 * 3/2004 Bodnar ..... 52/356
7,216,464 B2 * 5/2007 Neal et al. ..... 52/584.1
7,478,600 B2 * 1/2009 Beers et al. ..... 105/423
2002/0134043 A1 9/2002 Winterfeld

* cited by examiner

FIG. 2
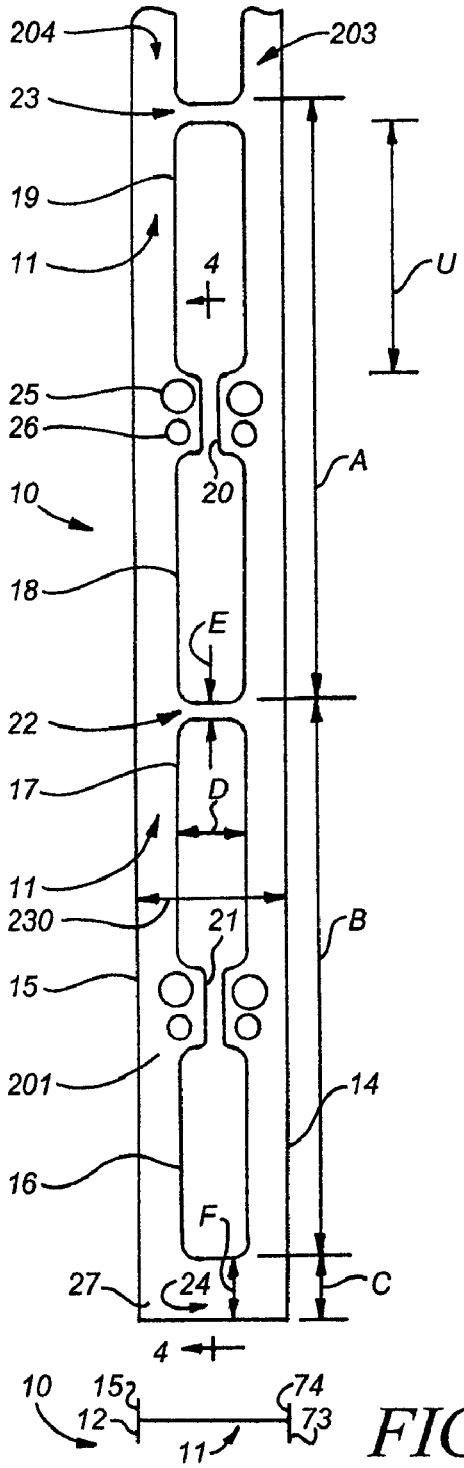
FIG. 2A
FIG. 3
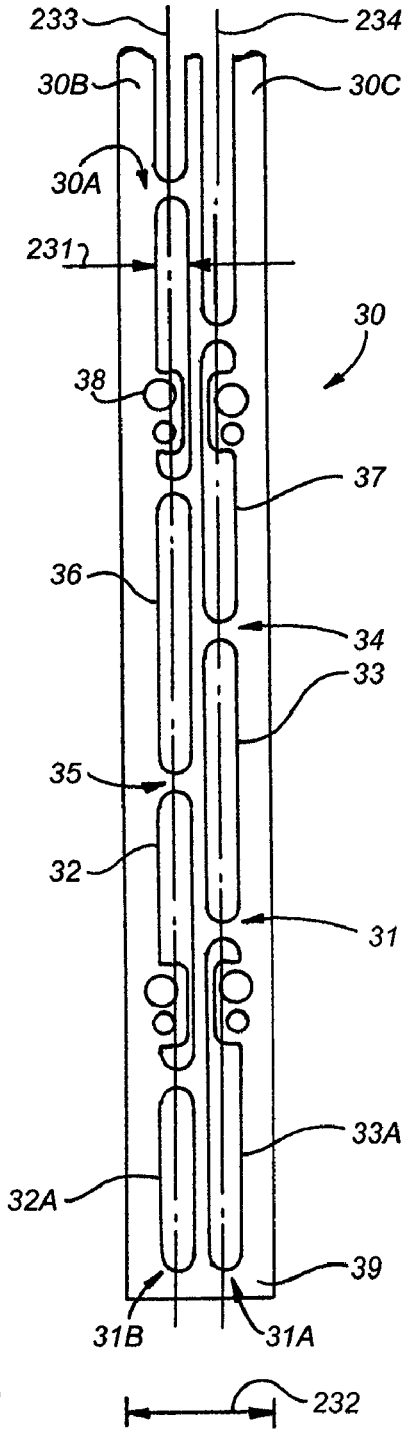

METHOD AND APPARATUS FOR ASSEMBLING STRONG, LIGHTWEIGHT THERMAL PANEL AND INSULATED BUILDING STRUCTURE

CLAIM TO DOMESTIC PRIORITY

The present application is a continuation of application Ser. No. 10/875,708, filed Jun. 24, 2004, which is a continuation of application Ser. No. 10/101,549, now U.S. Pat. No. 6,796,093, filed Mar. 18, 2002.

This invention relates to construction.

More particularly, the invention relates to a method and apparatus for assembling a strong, lightweight thermal panel.

In a further respect, the invention relates to a method and apparatus for quickly assembling a thermally insulated building structure.

For many years, residential and other building structures have been constructed by erecting a frame consisting of two by fours and other wood lumber, and by mounting sheet rock and other siding and insulation on or between the two by fours. One conventional disadvantage of wood frames is that they are susceptible to termite damage. Another disadvantage is that the wood currently used to build wood frames often is relatively "young" and not fully cured, which increases the likelihood the wood will warp after it is installed and after sheet rock and other siding is mounted on the wood. A further disadvantage of wood frames is that they are, because of wood shortages, becoming increasingly expensive. Another disadvantage of wood frames is that they are labor intensive. Still a further disadvantage of wood frames is that they are hydrophilic. Still another disadvantage of wood frames is that they tend to be permeable to heat.

Another construction technique, commonly found in commercial buildings, is the use of metal studs to construct interior, non-load bearing walls. Such metal studs ordinarily are not utilized for exterior walls because they are excellent transmitters of heat and because they are not strong enough to be utilized to construct a load bearing wall. Like wood frames, frames constructed with metal studs also tend to be labor intensive.

Accordingly, it would be highly desirable to provide an improved construction system which would minimize labor, would minimize the transmission of heat into or out of a building structure, would provide load bearing walls, would simplify construction, and would resist damage by insects.

Therefore, it is a principal object of the invention to provide an improved construction method and apparatus.

Another object of the invention is to provide structural panels which can be interchangeably utilized for the roof or wall of a structure.

A further object of the invention is to provide a construction system which permit the exterior walls and roof of a home to be erected in a single day.

These and other, further and more specific objects and advantages of the invention will be apparent to those of skill in the art from the following detailed description thereof, taken in conjunction with the drawings, in which:

FIG. 2 is a side elevation view further illustrating the metal stud of FIG. 1;

FIG. 3 is a side elevation view illustrating another metal stud constructed in accordance with the invention;

Figure 1:
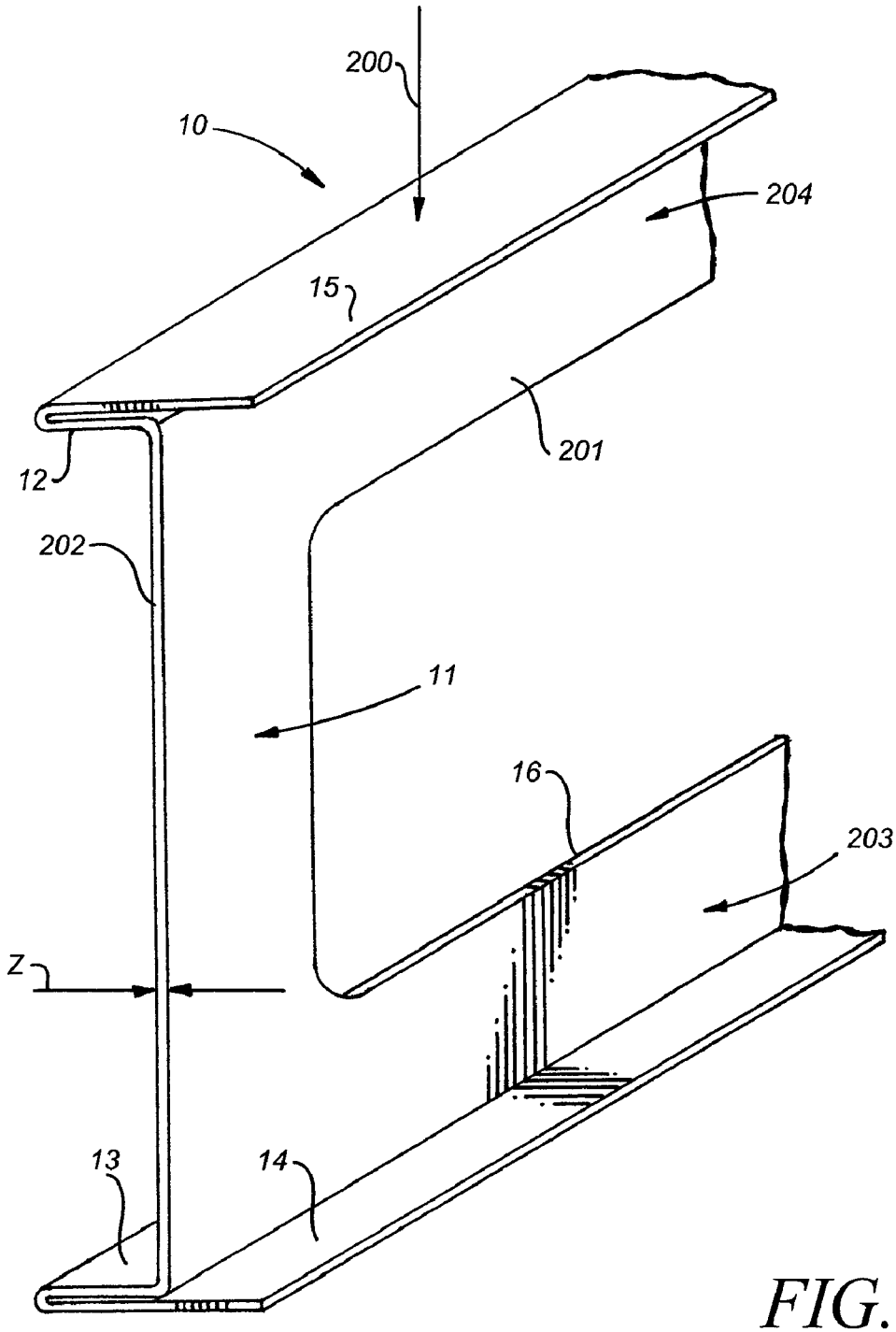
FIG. 1 is a perspective view illustrating the end of a metal stud constructed in accordance with the principles of the invention.

Briefly, in accordance with the invention, I provide an improved structural panel for a building. The panel includes at least first and second stud members each comprising an elongate member. Each stud member includes a neck having a selected thickness, a front, a back, a first elongate side, a second elongate side, and a cross-sectional area; includes a plurality of openings formed through the neck intermediate the first and second elongate sides and having a cumulative cross-sectional area and a cumulative area normal to the cumulative cross-sectional area, the cumulative cross-sectional area of the openings being at least equal to the cross-sectional area of the neck; and, includes a plurality of venturi bridges each adjacent at least one of the openings and extending from the first elongate side to the second elongate side of the stud. The venturi bridges have a cumulative cross-sectional area less that the cumulative cross-sectional area of the plurality of openings; a cumulative surface area on the front of the neck; and, a cumulative surface area on the back of the neck. Each stud member also includes at least one flange outwardly projecting from one of the sides of the neck. Each of the stud members is comprised of at least one metal having a thermal conductivity greater than 0.030 g-cal/(sec.)(sq. Cm.)(degree C./cm.) at eighteen degrees Centigrade. The panel also includes a foam panel having an outside face; an inside face; a top; a bottom; a first edge having a surface area extending between the inside face and the outside face and adjacent the front of the neck of the first stud member to form a first structural and thermal transmission interface; and, a second edge having a surface area extending between the inside face and the outside face and adjacent the back of the neck of the second stud member to form a second structural and thermal transmission interface. The ratio of the surface area of the first edge to the cumulative area of the openings in the neck of the first stud is in the range of 10:1 to 1.33:1 to limit the transmission of heat from the first stud to the first edge. The ratio of the portion of the surface area of the first edge to the cumulative surface area of the venturi bridges on the front of the neck of the first stud is in the range of 25:1 to 4:1 to limit the transmission of heat from the first stud to the first edge.

In another embodiment of the invention, I provide an improved lightweight substantially rigid shear-resistant structural panel for a building. The panel includes at least first and second stud members each comprising an elongate member. Each stud member includes a top; a bottom; a neck having a selected thickness, a front, a back, a first elongate side, a second elongate side, and a cross-sectional area; a plurality of openings formed through the neck intermediate the first and second elongate sides and having a cumulative cross-sectional area, the cross-sectional area of the openings being at least equal to the cross-sectional area of the neck; and, a plurality of venturi bridges each adjacent at least one of the openings and extending from the first elongate side to the second elongate side of the stud. The venturi bridges have a cumulative cross-sectional area less that the cross-sectional area of the plurality of openings; a cumulative surface area on the front of the neck; and, a cumulative surface area on the back of said neck. Each stud member also includes a first flange outwardly projecting from the first elongate side of the neck; and, a second flange outwardly projecting from the second elongate side of the neck and spaced apart from and opposed to the first flange. Each of the stud members is comprised of at least one metal having a thermal conductivity greater than 0.030 g-cal/(sec.)(sq. Cm.)(degree C./cm.) at eighteen degrees Centigrade. The wall panel also includes a foam panel having an outside face; an inside face; a top; a bottom; a first edge having a surface area extending between the inside face and the outside face, adjacent the front of the first stud member to form a first structural and thermal transmission interface, and between the first and second flanges of the first stud member; and, a second edge having a surface area extending between the inside face and the outside face, adjacent the back of the second stud member to form a second structural and thermal transmission interface, and between the first and second flanges of the second stud member. The wall panel also includes a first support member extending along the top of the foam panel between the first and second stud members. The support member includes a first end connected to the top of the first stud member and a second end connected to the top of the second stud member. The wall panel also includes a second support member extending along the bottom of the foam panel between the first and second stud members. The second support member includes a first end connected to the bottom of the first stud member and a second end connected to the bottom of the second stud member.

In a further embodiment of the invention, I provide an improved building construction. The building construction includes a wall; and, a thermally insulated roof having a slope greater than 2/12 and including a plurality of spaced apart metal studs with thermally insulative foam panels interposed between the studs, the studs being shaped and dimensioned to engage and support the panels between the studs.

In still another embodiment of the invention, I provide an improved method of constructing an enclosed thermally sealed building structure. The method includes the steps of constructing a wall including a top, a plurality of spaced apart metal studs, and, a plurality of thermally insulative foam panels interposed between said metal studs; constructing a roof including a plurality of elongate metal support members, and a plurality of thermally insulative foam panels interposed between said metal support members; installing the wall at a selected construction site; and, installing the roof on the wall such that a portion of the foam panels in the roof are adjacent the top of the wall and a portion of the foam panels in the wall to form a thermal seal between the roof and the top of the wall.

In still a further embodiment of the invention, I provide an improved method of reducing the thermal conductivity of a structural panel for a building. The wall includes at least first and second stud members each comprising an elongate member including a neck having a selected thickness, a front, a back, a first elongate side, a second elongate side, and a cross-sectional area; and, at least one flange outwardly projecting from one of the sides of the neck. Each of the stud members is comprised of at least one metal having a thermal conductivity greater than 0.030 g-cal/(sec.)(sq. Cm.)(degree C./cm.) at eighteen degrees Centigrade. The wall also includes a foam panel having an outside face; an inside face; a top; a bottom; a first edge having a surface area extending between the inside face and the outside face and adjacent the front of the first stud member to form a first structural and thermal transmission interface; and, a second edge having a surface area extending between the inside face and the outside face and adjacent the back of the second stud member to form a second structural and thermal transmission interface. The improved method includes the steps of forming a plurality of openings through the neck of at least the first stud member intermediate the first and second elongate sides and having a cumulative cross-sectional area and a cumulative area normal to the cumulative cross-sectional area; and, forming a plurality of venturi bridges in at least the first stud member. Each venturi bridge is adjacent at least one of the openings and extends from the first elongate side to the second elongate side of the stud. The venturi bridges have a cumulative cross-sectional area less that the cumulative cross-sectional area of the plurality of openings; a cumulative surface area on the front of the neck; and, a cumulative surface area on the back of the neck. The ratio of the portion of the surface area of the first edge adjacent the cumulative surface area of the venturi bridges on the front of the neck of the first stud is in the range of 25:1 to 4:1 to limit the transmission of heat from the first stud to the portion of the first edge extending from the openings in the first stud and venturi bridges in the first stud to the inside face of the foam panel.

In yet still a further embodiment of the invention, I provide an improved method of producing a strong, lightweight metal stud that minimizes the transmission of heat through the stud and resists forces that act to bend the stud. The method includes the steps of providing a thin elongate metal panel having a thickness and comprised of at least one metal having a thermal conductivity greater than 0.030 g-cal/(sec.)(sq. Cm.)(degree C./cm.) at eighteen degrees Centigrade; forming a plurality of openings through the panel to produce a plurality of venturi bridges each adjacent at least one of the openings; and, bending the panel. Bending the panel forms a neck having a thickness equal to said thickness of said metal panel; a front; a back; a first elongate side; and, a second elongate side. The plurality of openings are formed through the neck intermediate the said first and second elongate sides and have a cumulative cross-sectional area and a cumulative area normal to the cumulative cross-section area. The plurality of venturi bridges each extend from the first elongate side to the second elongate side of the stud. The venturi bridges each have a cumulative cross-sectional area less that the cross-sectional area of the plurality of openings; have a cumulative surface area on the front of the neck; and, have a cumulative surface area on the back of the neck. Bending the panel also forms a first flange outwardly projecting from the first elongate side of the neck and having a thickness at least twice the thickness of the metal panel; and, forms a second flange outwardly projecting from the second elongate side of the neck, spaced apart from and opposed to the first flange, and having a thickness at least twice the thickness of the metal panel.

In yet still another embodiment of the invention, I provide an improved method of producing a structural panel for a building. The method includes the step of providing at least first and second stud members each comprising an elongate member. Each stud member includes a neck having a selected thickness; a front; a back; a first elongate side; and a second elongate side. Each stud member also includes at least one flange outwardly projecting from one of the sides of the neck. Each of the stud members is comprised of at least one metal having a thermal conductivity greater than 0.030 g-cal/(sec.)(sq. Cm.)(degree C./cm.) at eighteen degrees Centigrade. The method also includes the step of providing a foam panel. The foam panel has an outside face; an inside face; a top; a bottom; a first side having a surface area and having a pair of spaced apart edges; and, a second side having a surface area and having a pair of spaced apart edges. The method also includes the step of positioning the foam panel intermediate the first and second metal stud members such that a portion of the first side extends between the inside face and the outside face and adjacent the front of the first stud member to form a first structural and thermal transmission interface; such that one of the edges of the first side is adjacent the front of the first stud member; such that a portion of the first side extends away from the first stud member; such that the other of the edges of the first side is spaced apart from the first stud member; such that a portion of the second side extends between the inside face and the outside face and adjacent the back of the second stud member to form a second structural and thermal transmission interface; such that one of the edges of the second side is adjacent the back of the second stud member; such that a portion of the second side extends away from the second stud member; and, such that the other of the edges of the second side is spaced apart from the second stud member. The method also includes the steps of placing a structural member along the other of the edges of the second side; and, interconnecting the structural member and the second stud with a plurality of spaced apart support members each having a first end connected to the structural member and a second end connected to the second stud.

Turning now to the drawings, which depict the presently preferred embodiments of the invention for the purpose of illustration thereof, and not by way of limitation of the invention, and in which like characters refer to corresponding elements throughout the several views, FIGS. 1 and 2 illustrate an I-shaped metal stud generally indicated by reference character 10 and including a neck 11 and flanges 12 to 15 outwardly depending from and normal to neck 11. Neck 11 has a selected thickness indicated by arrows Z in FIG. 1. The thickness of flanges 14 and 15 is identical to the thickness of neck 11. The thickness of flanges 12 and 13 is twice that of neck 11 because the metal is doubled back, or bent back, on itself to form flanges 12 and 13. Doubling the thickness of flanges 12 and 13 is important because it makes the I-stud 10 significantly stronger and more resistant to forces which act normal to flanges 12, 13 in the direction of arrow 200 and which tend to cause stud 10 to bend, or flex. Neck 11 includes a flat front surface 201 and a flat back surface 202 parallel to and spaced apart from surface 201. Neck 11 also includes a first elongate side 203 and a second elongate side 204 parallel to the first elongate side 203. Side 203 generally extends the entire length of flanges 13 and 14 and of stud 10. Flanges 13, 14 outwardly depend from side 203. Side 204 generally extends the entire length of flanges 12 and 15 and of I-stud 10. Flanges 12 and 15 outwardly depend from side 204.

A plurality of generally rectangular openings 16 to 19, 20, 21 are formed through neck 11. The shape and dimension of each of the openings can vary as desired. The area of each opening 16 to 19 is calculated by multiplying the length U times the width D. Each opening 16 to 19 has a shape and dimension equivalent to the other openings 16 to 19. The area of each generally rectangular opening 20, 21 is also calculated by multiplying the length of the opening times the width of the opening. When the areas of each opening 16 to 21 are summed, a cumulative area of the openings is obtained. This cumulative area includes the area of openings 16 to 19, 20, 21 and of any other comparable openings in neck 11. Circular openings like openings 25 and 26 are formed through neck 11 to facilitate threading electric wiring and other cables or lines through I-stud 10. The circular area of these openings 25, 26 are included when calculating the cumulative area of the openings in neck 11. Openings 16 to 19 also have a cumulative cross-sectional area. The cumulative cross-sectional area of openings 16 to 19, 20, 21 represents the area which is not available to heat for direct transmission from one elongate side 203 of neck 11 to the other elongate side 201 of neck 11. The cross-sectional area of openings 17, 21, 16 is calculated by multiplying the width of neck 11, indicated by arrows R in FIG. 4, times the height spanned by the openings, which height is indicated by arrow N in FIG. 4. The cross-sectional area of other openings 18, 20, 19 in neck 11 is similarly calculated. The cross-sectional area of all the openings in neck 11 is summed to obtain the cumulative cross-sectional area. The cross-sectional area of each circular opening 25, 26 is also included in the cumulative cross-sectional area because these openings also interfere with the transmission of heat from side 203 to 201. Similarly, when the cumulative cross-section area of the openings 43, 44, 48 in stud 40 is calculated, the cross-sectional area of the openings 51, 52 provided for electrical, plumbing, and other lines is included. The cross-sectional area of a circular opening 25, 26 equals the diameter (or height) of the opening multiplied by the width R of neck 11.

The surface area on the front of neck 11 equals the overall area of neck 11 minus the cumulative area of all the openings 16 to 21, 25, 26 formed through neck 11. The overall area of neck 11 equals the width of neck 11, indicated by arrows 230 in FIG. 2, multiplied by the height of neck 11, indicated by the sum of the distances indicated by arrows A, B, C plus the remaining height of stud 10 (not shown).

The surface area of the back of neck 11 is equivalent to the surface area on the front of neck 11. The surface area on the front of neck is generally equal to the surface area of side 201 plus the surface area of side 203 plus the surface area of the venturi bridges 22, 24, 23 in stud 10.

Each venturi bridge 22 to 24 is adjacent at least one of openings 16 to 21, 25, 26 and has a surface area on the front of neck 11 and a surface area on the back of neck 11. Each venturi bridge 22 to 24 extends between sides 201 and 203. In FIG. 2, the surface areas of venturi bridges are flat, as are the surface areas of sides 201 and 203. This need not be the case. The surface areas of bridges 22 to 24 and side 201 and 203 can be contoured. For example, in FIG. 3A, ribs or raised areas 45 and 46 are formed on venturi bridges 50 and 50A (but not on venturi bridges 49 and 49A). Since each venturi bridge has a generally orthogonal shape, the surface area of each venturi bridge 22 to 24 on the front of neck 11 is calculated by multiplying the width of each bridge times the height of each bridge. The surface area of bridge 24 on the front of neck 11 is calculated by multiplying the width, indicated by arrows D times the height, indicated by arrows F. The surface area of venturi bridge 22 is calculated by multiplying the width, indicated by arrows D, times the height, indicated by arrows E. The surface area of venturi bridge 23 is calculated by multiplying the width, indicated by arrows D, times the height. The height of bridge 23 is the same as that of bridge 22. The cumulative surface area of bridges 22 to 24 on the front of neck 11 (and any other venturi bridges in stud 10) is calculated by summing the surface area of each bridge 22 to 24 on the front of neck 11. The surface area of each bridge 22 to 24 on the back of neck 11 is similarly calculated. In stud 10, the surface area of bridges 22 to 24 on the back of neck II equals the surface area of bridges 22 to 24 on the front of neck 11.

Bridges 22 to 24 also have a cumulative cross-sectional area. The cumulative cross-sectional area of bridges 22 to 24 represents the area which is available to heat for direct transmission from one elongate side 203 of neck 11 to the other elongate side 201 of neck 11. The cross-sectional area of bridges 17, 21, 16 is calculated by multiplying the width of each bridge, indicated by arrows R in FIG. 4, times the height of the bridge. The cross-sectional area of all the venturi bridges in neck 11 is summed to obtain the cumulative cross-sectional area of the venturi bridges. The cross-sectional area of venturi bridge 24 equals the width, indicated by arrows R in FIG. 4, times the height, indicated by arrows P in FIG. 4 (and arrows F in FIG. 2). The cross-sectional area of venturi bridge 22 equals the width, indicated by arrows R in FIG. 4, time the height, indicated by arrows Q in FIG. 4 (and arrows E in FIG. 2). The cross-sectional area of bridge 23 equals the cross-sectional area of bridge 22.

I-stud 30 illustrated in FIG. 3 is constructed in accordance with an alternate embodiment of the invention. The stud 30 includes circular openings 38 extending through neck 30A to facilitate the passage of electrical, plumbing, and other lines through neck 30A. A plurality of openings 32,33, 36, 37 are formed through stud 30, producing a plurality of venturi bridges 31, 35, 34. Each venturi bridge is adjacent at least one opening. For example, venturi bridge 34 is adjacent opening 37 and opening 33. Venturi bridge 31A is adjacent opening 33A. Venturi bridge 31B is adjacent opening 32A. Each venturi bridge 31, 31A, 31B, 35, 34 has a width equivalent to the width of the portion of the opening(s) to which it is adjacent. The portion of each opening 32A, 33A, 32, 33, 36, 37 adjacent a venturi bridge in FIG. 3 has an equivalent width indicated by arrows 231. If a venturi bridge 34 is intermediate and adjacent a portion of each of pair of openings 33 and 37, and the portion of one opening adjacent the venturi bridge is wider than the portion of the other opening that is adjacent the venturi bridge, the length of the venturi bridge is equal to the width of the portion with the smaller dimension. When a venturi bridge 31A is at the bottom 39 (or top) of a stud 30, the length of the venturi bridge is equal to the width of the opening 33A to which the bridge is adjacent, and is not equal to the width, indicated by arrows 232, of the bottom of stud 30. Neck 30A includes sides 30B and 30C.

The cumulative area of all the openings formed in neck 30A of stud 30 is determined by adding together the area of each opening in neck 30A. The cumulative surface area on the front (or back) of neck 30A for the venturi bridges in stud 30 is determined by adding together the surface area on the front (or back) of neck 30A for each venturi bridge. On the other hand, the cross-sectional area of the openings formed through neck 30A is determined by selecting the axis 233, 234 that passes through openings having the greatest cumulative cross-sectional area. Axes 233 and 234 are parallel to the elongate centerline of stud 30. The elongate centerline is generally parallel to the flanges (for example, flanges 14 and 15 in FIG. 1) extending along the sides of neck 30A. If the openings through which axis 234 extends have a greater cumulative cross-sectional area than the openings through which axis 233 extends, the cumulative cross-sectional area of neck 30A equals the cumulative cross-sectional area of the openings through which axis 234 extends.

Figure 3A:
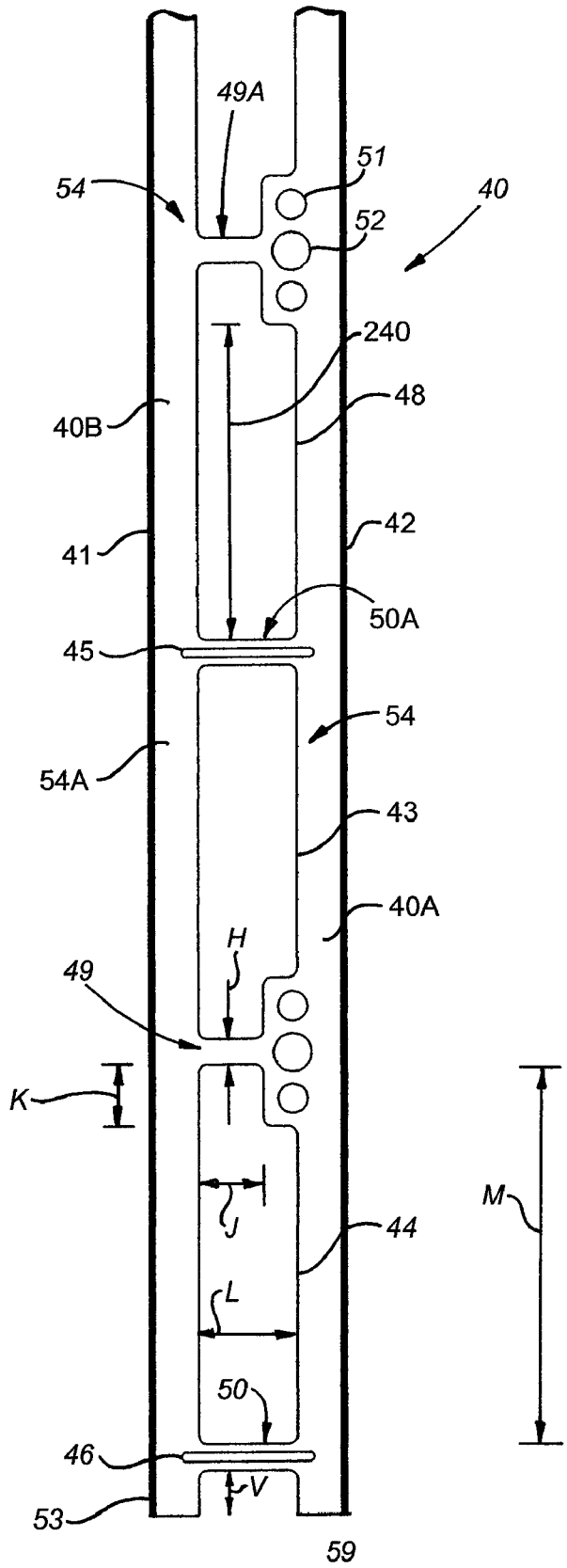
FIG. 3A is a side elevation view illustrating still another metal stud constructed in accordance with the invention.
Figure 4:
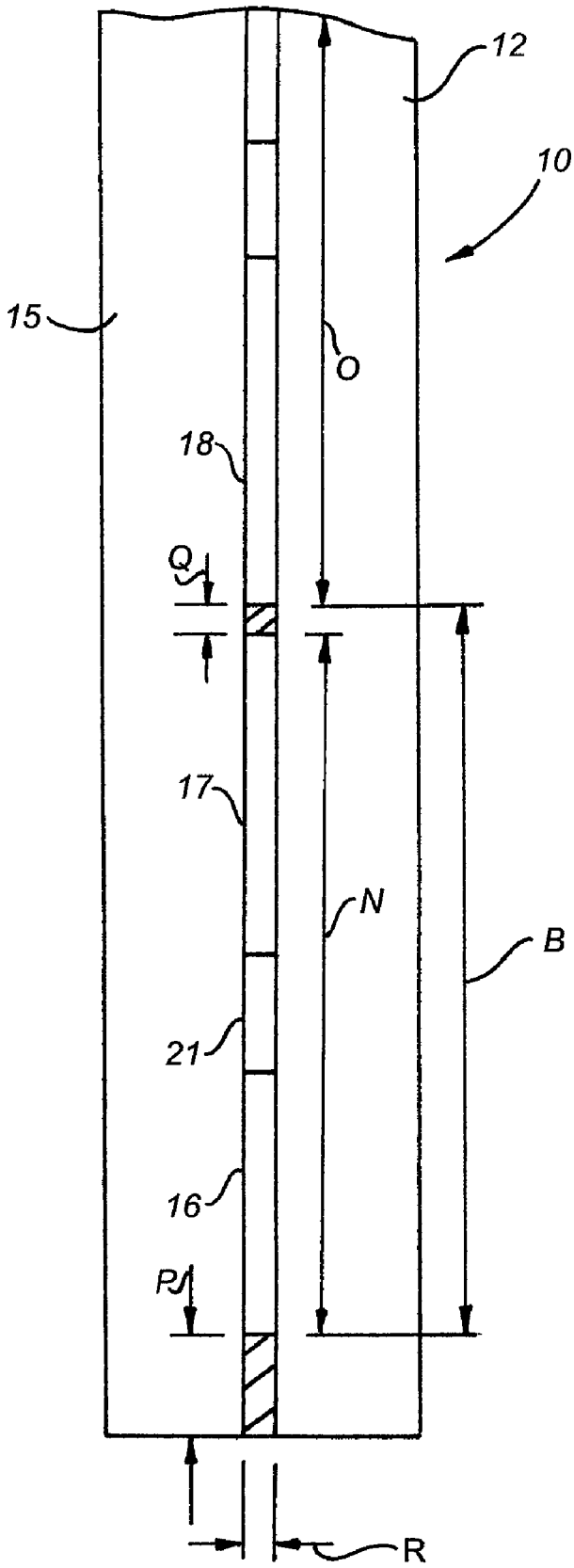
FIG. 4 is a section view of the metal stud of FIG. 2 illustrating further construction details thereof.

In FIGS. 2 and 4, the length of an "opening-venturi bridge unit" is indicated by arrows B. The length of another "opening-venturi bridge unit" is indicated by arrows A in FIG. 2 and is equivalent to the length indicated by arrows B. In FIG. 4, arrows N indicate the cumulative length of openings 16, 21, 17. In FIG. 3A, arrows M indicate the length of opening 44. In FIG. 4, arrows O indicate the length of a portion of the openings 18, 20, 19 shown in FIG. 4.

Figure 6:
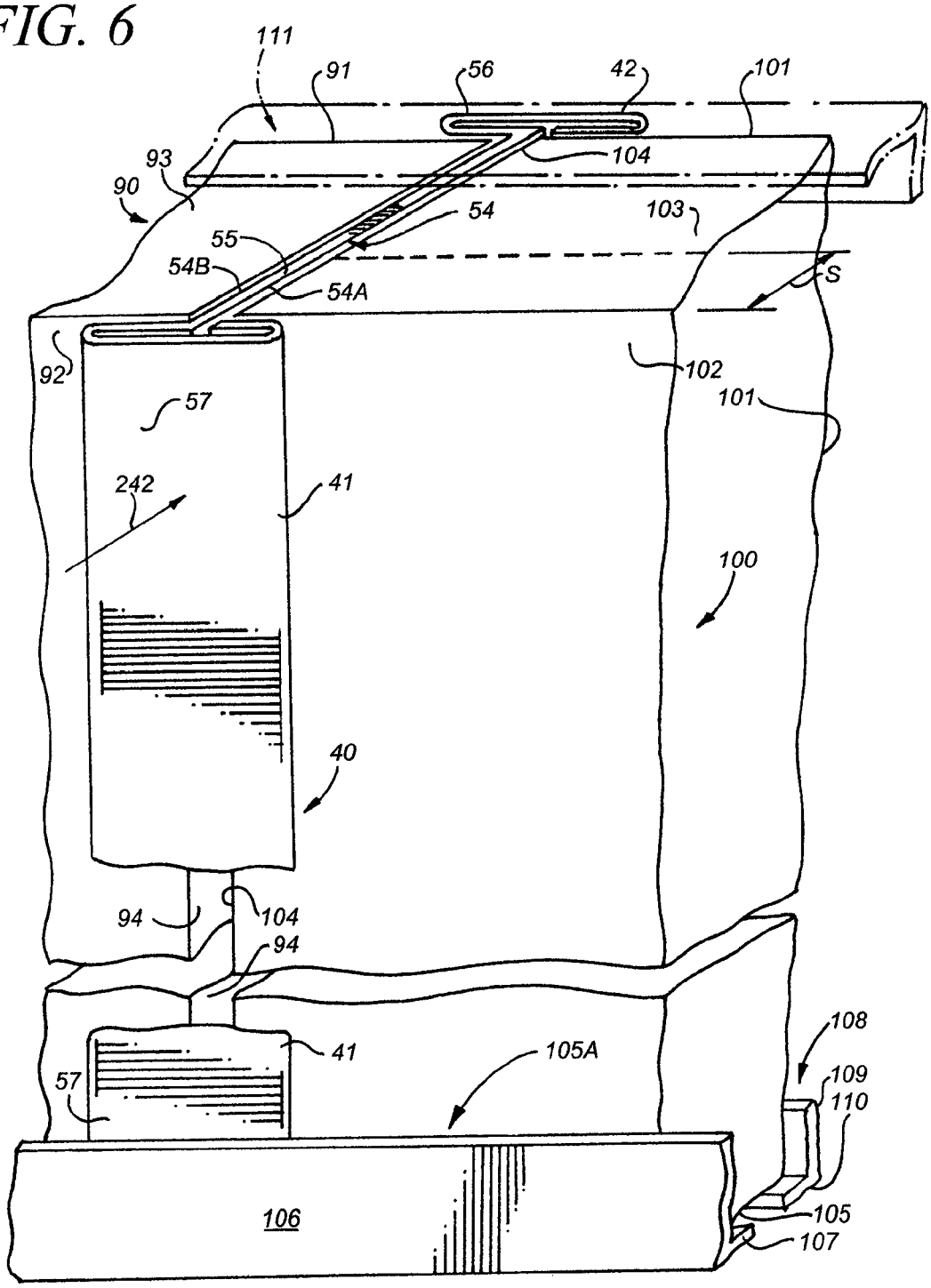
FIG. 6 is a perspective view illustrating construction details of a structural panel used in the wall or roof of a building structure.

I-stud 40 illustrated in FIGS. 3A and 6 includes a neck 54 and flanges 41, 42, 56, 57. The strength of flanges 41, 42, 56, 57 is significantly increased because the metal forming the flanges is doubled over on itself. Neck 54 includes front 54A, back 54B, a first elongate side 40A extending the length of stud 40, and a second elongate side 40B extending the length of stud 40. A plurality of openings 43, 44, 48 are formed through neck 54. The area of each opening 43,44, 48 is calculated by first multiplying the width, indicated by arrows L, times the height indicated by arrows 240 to obtain a first value. Then, the width, indicated by arrows J, of the smaller tip of the opening is multiplied by the height, indicated by arrows K, of the small tip to obtain a second value. The first and second values are added to obtain the area of opening 44. Openings 44, 43, and 48 each are of equal shape and dimension, although this need not be the case. The area of the small opening at the bottom 53 of stud 40 is calculated by multiplying the height, indicated by arrows V, times the width, indicated by arrows L. Stud 40 includes venturi bridges 49, 50 49A, 50A. Each venturi bridge extends between sides 40A and 40B. The surface area of the venturi bridge 49 on the front 54A of neck 54 is calculated by multiplying the height, indicated by arrows H, times the width, indicated by arrows J. The surface area of bridge 49A on the front of neck 54 is equal to that of bridge 49. The surface area of venturi bridge 50 on the front of neck 54 is calculated by multiplying the height, which is equal to the height H of bridge 49, times the width, indicated by arrows L. The surface area of bridge 50A on the front of neck 54 equals that of bridge 50. The surface area of each bridge on the back 54B of neck 54 is equal to the surface area of the bridge on the front of neck 54, although that need not be the case. Ribs or detents 45, 46 do not significantly alter the surface area of bridges 45 and 46. The cumulative surface area of the venturi bridges on the front of neck 54 is calculated by summing the surface area of each bridge. The cumulative area of openings 51, 52, 43, 44, etc. is calculated by summing the area of each opening. The cumulative cross-sectional areas of the openings and venturi bridges is calculated in the manner earlier described for stud 10.

FIGS. 5, 8 to 11 illustrate the components of a panel structure utilized to construct the roof of a building in accordance with the invention. The panel structure of FIG. 5 can also, if desired, be utilized in constructing the wall of a building. The panel structure in FIG. 5 includes a foam panel or board 66 shown in ghost outline. Panel 66 includes a bottom 62, a top (not shown) parallel to bottom 62, an outside face (i.e., the top of the roof 60, an inside face 61 (i.e., the ceiling inside a building structure), a first side 63, and a second side (not shown) parallel to first side 63. Side 63 includes spaced apart peripheral edges 64 and 65. An elongate groove 111 having a U-shaped cross-section is formed in side 63. A groove similar to groove 111 is also formed in the second side of panel 66.

Foam panel 110 is also indicated in ghost outline and is identical in shape and dimension to panel 66. An elongate groove 112 is formed in the second side of panel 110. Groove 112 is identical to the groove formed in the second side (not visible) of panel 60. The shape and dimension of groove 112 is identical to that of groove 111, although groove 112 opens in a direction opposite that of groove 111.

H-shaped metal stud 70 is similar to metal studs 10, 30, and 40, except that stud 70 does not include openings formed through the neck 75 of stud 70. In addition, neck 75 is not flat like necks 11, 30A, 54. Instead, neck 75 has sections or ribs 80, 76, 77, etc. that are offset from one another.

One principle function of the openings and venturi bridges formed in the necks of studs 10, 30, and 40 is to reduce the conduction of heat into the necks of the studs. This is important in the combination of the invention because C-shaped or I-shaped metals studs are used to interconnect and secure foam panels. Foam panels provide efficient thermal insulation. This thermal insulation can be breached and bypassed if heat is readily transmitted from the neck of the metal studs to foam panels and from foam panels into the interior space in a building. The structure of studs 10, 30, 40 minimizes the transfer of heat at the neck-foam panel interface. In contrast, the panel structure of FIG. 5 does not require that the conduction of heat in the neck 75 of metal stud 70 be minimized, although the offset ribs 80, 76, 66, etc. do function to limit the transfer of heat from neck 75 to the side 63 of a panel 66. The panel structure of FIG. 5 prevents the transmission of heat from the outside face 60 to the inside face 61 by using foam panels 60, 110 in which the inside face 61 is spaced apart from the bottom flanges 73 and 74. In addition, edge 65 of side 63 is supported by an elongate L-shaped structural member 86. Member 86 is connected to stud 70 by a plurality of spaced apart elongate structural arms or members 81. Since the cumulative width of spaced apart arms 81 is much less than the total length of a stud 70, the heat transmitted from flange 70 and through arms 81 to member 86 is greatly minimized. The maximum width 81W of an arm 81 is typically only 0.1" to 2" per foot of stud length. In other words, the total cumulative width of the arms 81 used along the length of a stud is about 0.8% to 25% of the length of the stud, preferably 4% to 10%. If desired, openings 89 can be formed through arms 81 to further minimize the transmission of heat from flange 70 through arms 81 to member 86. Any desired means can be utilized to secure and arm 81 to flange 70 and member 86. It is presently preferred to rivet upper end 82 through aperture 84 to rib 77 of flange 70, and, to rivet lower end 83 through aperture 85 to leg 87 of member 86. Leg 87 depends from leg 88 of member 86. A plurality of spaced apart apertures 123 are formed through flange 74 to permit an arm 81 to slide therethrough in the manner illustrated in FIG. 5.

Figure 11:
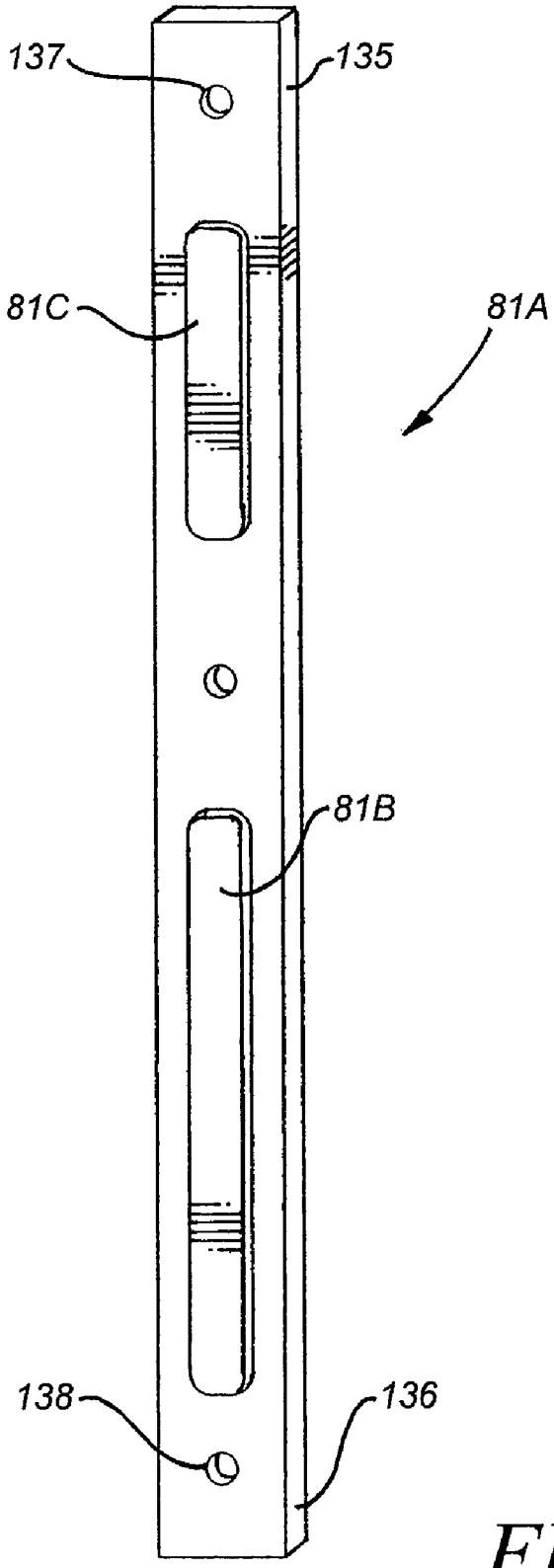
FIG. 11 is a perspective view illustrating a support member utilized in the panel construction of the type illustrated in FIGS. 5, 8, 9, and 10.
Figure 12:
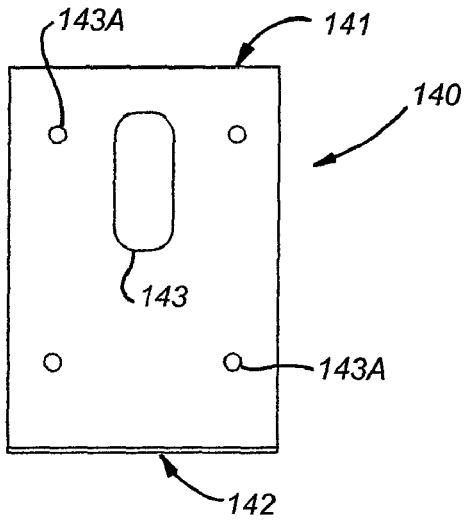
FIG. 12 is a front view illustrating a bracket utilized in wall construction of the type illustrated in FIG. 8.
Figure 13:
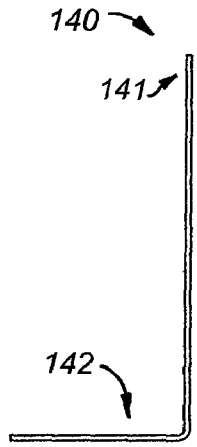
FIG. 13 is a side view illustrating the bracket of FIG. 12.
Figure 14:
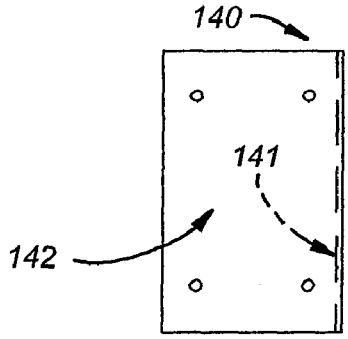
FIG. 14 is a bottom view illustrating the bracket of FIG. 12.
Figure 15:
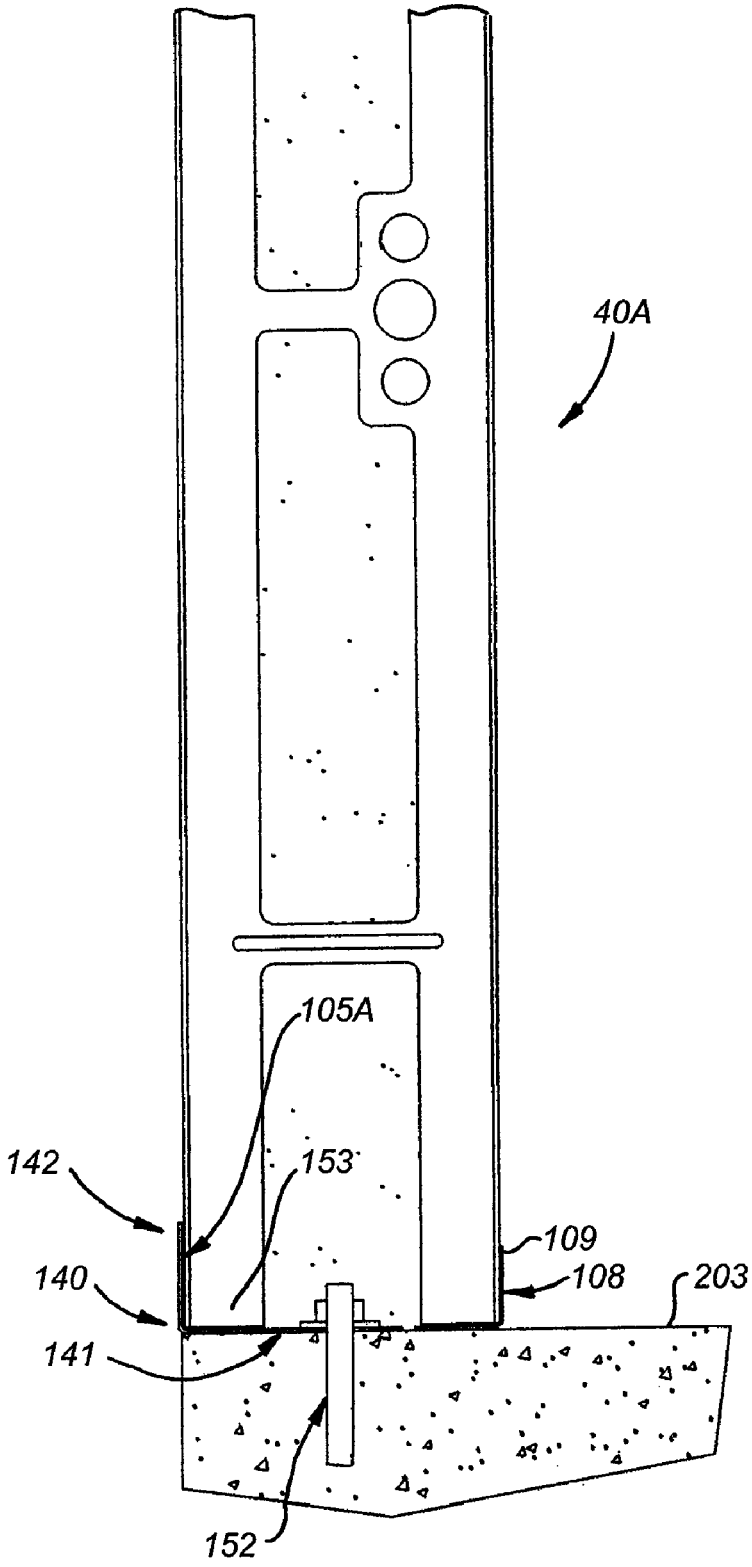
FIG. 15 is an enlarged side view illustrating the attachment to the floor of the wall construction of FIG. 8.

FIG. 11 illustrates an arm 81A which can be utilized in place of arm 81. Arm 81A includes upper end 135 with aperture 137 formed therethrough, and includes lower end 136 with aperture 138 formed therethrough. Detents 81B, 81C strengthen arm 81A.

Figure 8:
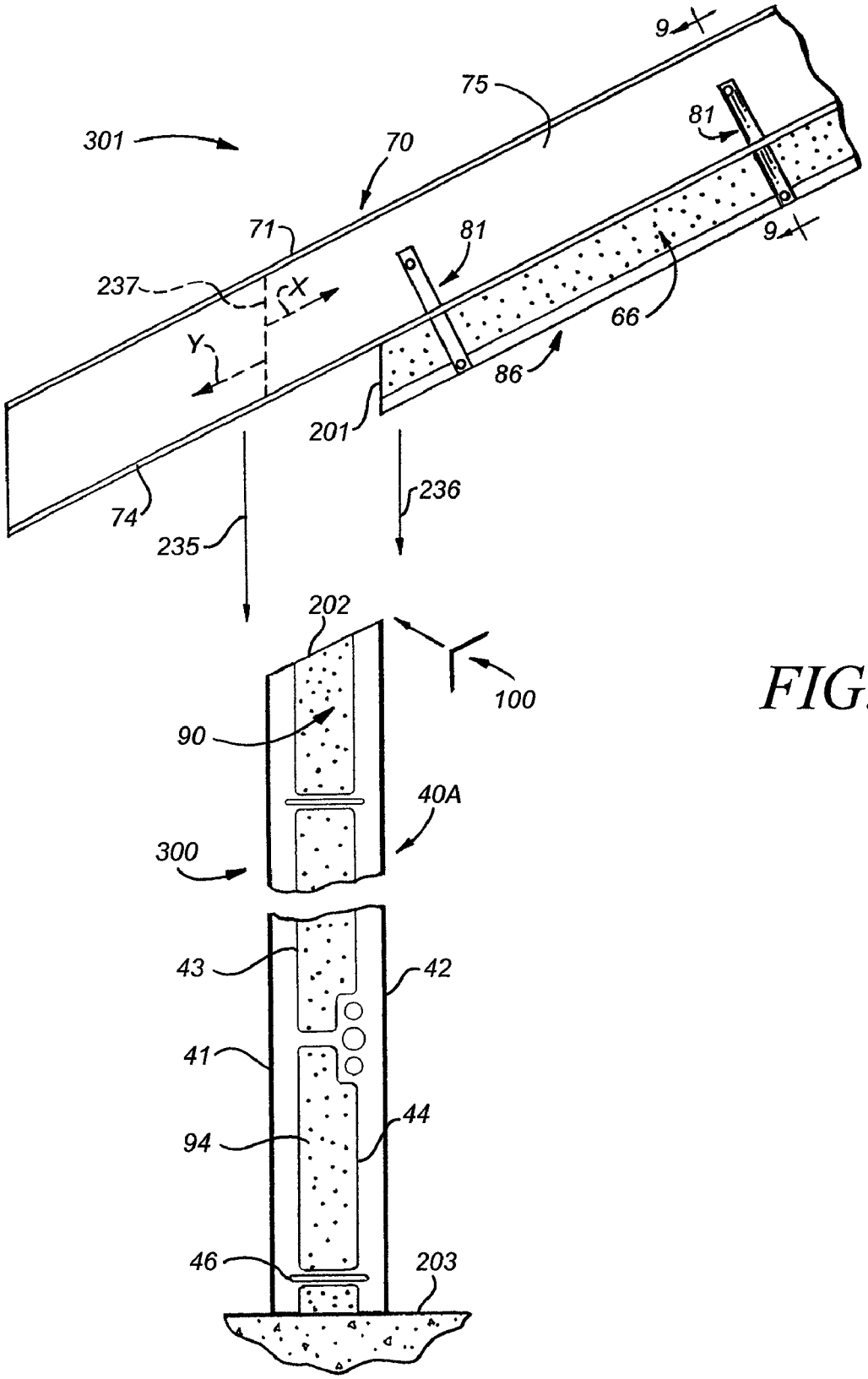
FIG. 8 is a side elevation view illustrating a building structure constructed in accordance with the invention.
Figure 10:
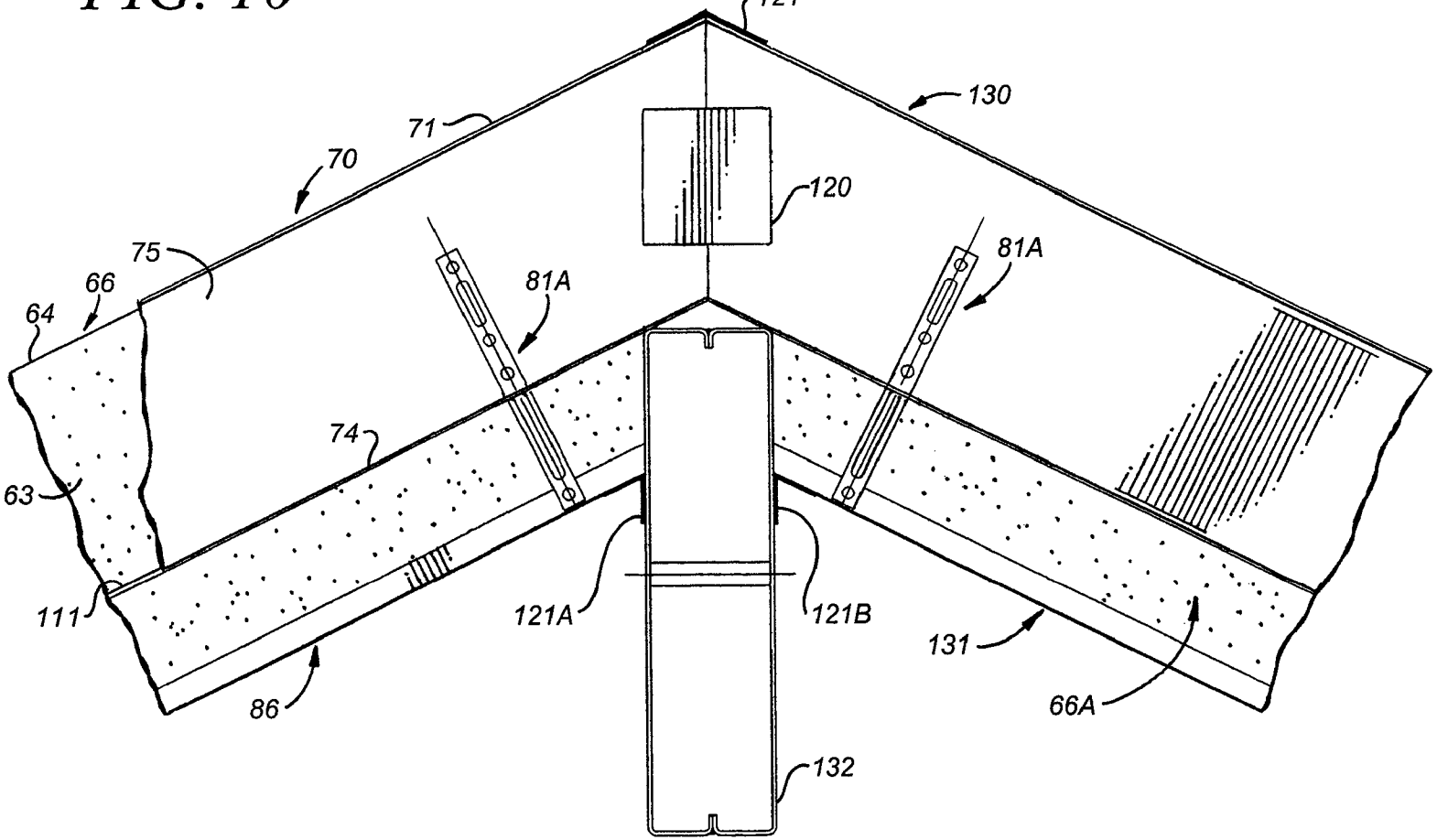
FIG. 10 is a side elevation view further illustrating the roof of the building structure of FIG. 8.

Stud 70 includes flanges 71 and 72 along one side and includes flanges 73 and 74 along the other side. Neck 75 extends between flange pair 71-72 and flange pair 73-74. Neck 75 includes parallel, interconnected, offset panels or ribs 80, 76, 77, 78, 79. As noted, the offset design of ribs 76-80 functions to split between panels 66 and 110 the quantity of heat that is transmitted from neck 75 to the sides of panels 66 and 110. If desired, however, a neck 75A which is essentially flat and lies in one plane in the manner of necks 54, 30A and 11 can be utilized in place of the neck 75 illustrated in FIG. 5. In FIGS. 8 and 10 the offset ribs 76-80 of neck 75 are not, for the sake of clarity, depicted. Nor are the offset ribs of arm 81 depicted in FIG. 8. In FIG. 10, arms 81A are shown being used in place of arms 81.

In FIG. 8, foam panel 110 is omitted for purposes of clarity. Foam panel 66 is in part obscured behind sloped stud 70 and is in part visible because it extends down past flange 74. When foam panel 110 is put in place, the second side is placed against stud 70 intermediate flanges 71 and 74 in the manner illustrated in FIG. 5, and, another stud is placed along the first side of panel 110 in the same manner that stud 70 extends along the first side of panel 66 in FIG. 5. The stud placed along the first side of panel 110 has a C-shape if another foam panel will not be placed adjacent the first side of panel 110. If an additional foam panel will be placed adjacent the first side of panel 110 in the same manner that panel 110 is placed against the first side of panel 66 in FIG. 5, then, as would be appreciated by those of skill in the art, the stud placed along the first side of panel 110 is I-shaped so that the stud has flanges which will support both panel 110 and the additional foam panel.

In FIG. 8, foam panel 66 and foam panels adjacent panel 66 are notched to form a V-shaped notch including planar flat rectangular surface 201 and the bottom of flange 74. This notch permits panel 66 and flange 70 to be displaced downwardly in the direction of arrows 235 and 236 to engage and conform to the top of the wall 300. Surface 201 slides along the outside of foam panel 90 and flange 42. The bottom of flange 74 rests on sloped top surface 202 of vertically oriented wall 300. V-shaped bracket 100 is riveted to stud 40A and to member 86. Stud 40A is equivalent in shape and dimension to stud 40, except that the top of stud 40A and of panel 90 are cut to form sloped surface 202 so that when foam panel 90 is installed in the manner shown in FIG. 8, the top of panel 90 and top of stud 40A cooperatively form sloped surface 202.

In roof 301, panel 66, along with other panels coplanar with panel 66, extends at least to dashed line 237. See FIG. 16. In other words, panel 66 extends from dashed line 237 in the direction of arrow X, but does not extend from dashed line 237 in the direction of arrow Y. Although not necessary, it is preferred that panel 66 completely cover the portion of the sloped surface 202 over which panel 66 extends. This is important in forming an efficient thermal seal between roof 301 and wall 300. If panel 66 extends only partially across surface 202, this in effect reduces the R value (i.e., reduces the ability to prevent the transmission of heat) of the roof—wall joint or interface. The ability to form a well sealed thermal envelope at the roof—wall interface is an important advantage of the invention.

Figure 9:
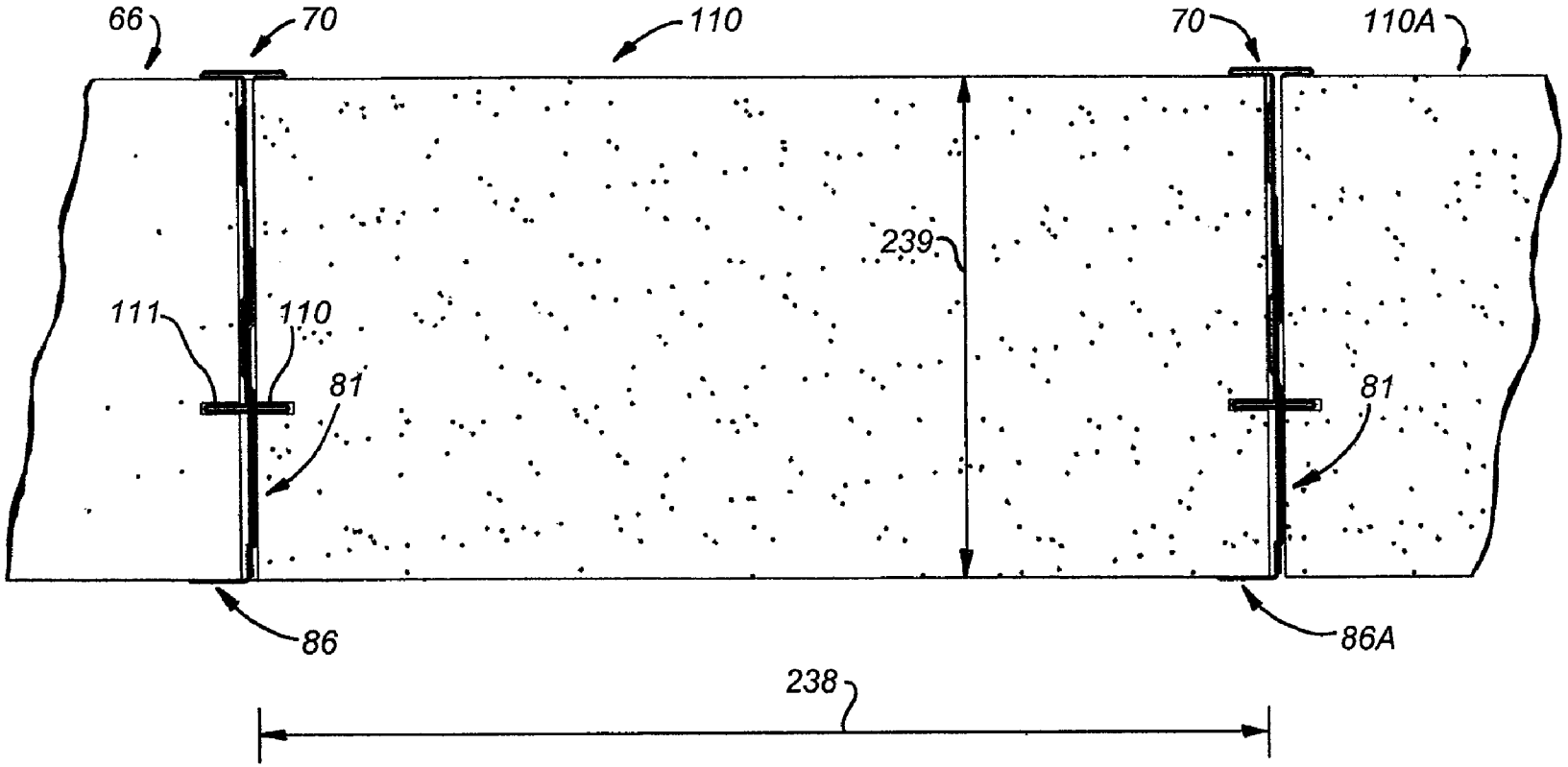
FIG. 9 is a section view of the building structure of FIG. 8 illustrating further construction details thereof and taken along section line 9-9.

FIG. 9 further illustrates the roof construction of FIG. 8 including foam panels 66 and 110, flanges 70 and arms 81. The shape and dimension of each orthogonal panel 66, 110, and 110A is identical, although this need not be the case. The shape and dimension of the roof panels can vary as desired. The width 238 of a foam roof panel is presently two feet. The thickness 239 of a foam roof panel is presently twelve inches. The thickness, width, and length of a foam roof panel can vary as desired. Since the width 238 of a foam roof panel 66 is two feet, each parallel pair of metal studs 70 supporting a panel 66 is about two feet apart. Since the thickness of a roof panel is twelve inches, the outside face 60 is twelve inches from the inside face 61.

FIG. 10 illustrates one possible construction of the crown of a roof in the practice of the invention. In FIG. 10, stud 70 and foam panel 66 on one side of the roof abut against a comparable stud 130—foam panel 66A structure on the other side of the roof. Metal panel 120 is riveted or otherwise secured to studs 70 and 130. The upper most ends of studs 70 and 130 rest, along with foam panels 66 and 66A, on vertically oriented cross beam or support beam 132. In FIG. 10, beam 132 is normal to the sheet of paper on which the drawing is inscribed. Bracket 121 is riveted to flanges on studs 70 and 130. V-shaped bracket 121A is riveted to beam 132 and member 86. V-shaped bracket 121B is riveted to beam 132 and member 131.

FIG. 6 illustrates a structural panel used in the construction of a wall in a building. The structural panel illustrated in FIG. 6 can also be utilized to construct the roof of a building.

In FIG. 6, the interface between stud 40 and a pair of foam panels 90 and 100 is illustrated. I-stud 40 is illustrated in FIG. 3A. As earlier noted, the strength of stud 40 is significantly improved because each flange 41, 42, 56, 57 consists of metal which is doubled over on itself and which is therefore thicker than the metal comprising neck 54. Typically each flange 41, 42, 56, 57 is twice as thick as the neck 54. This result can, of course, be varied depending on the thickness and configuration of the metal plate(s) used to form a stud 40. Each flange might only be 1.5 times as thick as neck 54, or, might be three times as thick as neck 54 if the portion of the metal plate used to form the flanges had a different thickness than the portion of the metal plate used to form neck 54. The thickness of a flange can be increased by attaching another piece of material to the flange.

Orthogonal foam panel 90 includes outside face 91 (i.e., the face exposed to the outdoors), inside face 92 (i.e., the face exposed to the interior of a building) parallel to face 91, top 93, a bottom (not visible) parallel to top 93, a first rectangular edge 94 extending between the inside face 92 and the outside face 91, and a second rectangular edge (not shown) parallel to edge 94 and extending between inside face 92 and outside face 91. Edge 94 is adjacent and contacting the back 54B of neck 54. Edge 94 preferably fits snugly between flanges 56 and 57 such that flange 57 contacts inside surface 92 and flange 56 contacts outside surface 91.

Foam panel 100 includes outside face 101 (i.e., the face exposed to the outdoors), inside face 102 (i.e., the face exposed to the interior of a building) parallel to face 101, top 103, bottom 105 parallel to top 103, a first rectangular edge (not visible) extending between the inside face 102 and the outside face 101, and a second rectangular edge 104 parallel to the first rectangular edge and extending between inside face 92 and outside face 91. Edge 104 is adjacent and contacting the front 54A of neck 54.

Edge 104 preferably fits snugly between flanges 41 and 42 such that flange 41 contacts inside face 102 and flange 42 contacts outside face 101. This configuration of the structural combination of stud 40 and of panel 100 (or 90) strengthens stud 54 because panels 90 and 100 resist compression and therefore help prevent stud 54 from bending when a shear force is applied to stud 54 in the direction of arrow 242. Similarly, flanges 41 and 42 function to hold the edge 104 in a fixed position, which increases the ability of edge 104 and panel 100 to resist a force acting on panel 100 in the direction indicated by arrow 242. In the roof panel construction illustrated in FIG. 5, the portion of each side 63 of a foam panel extending between a pair of flanges 72 and 73 also preferably also fits snugly between such flanges 72, 73.

Figure 17:
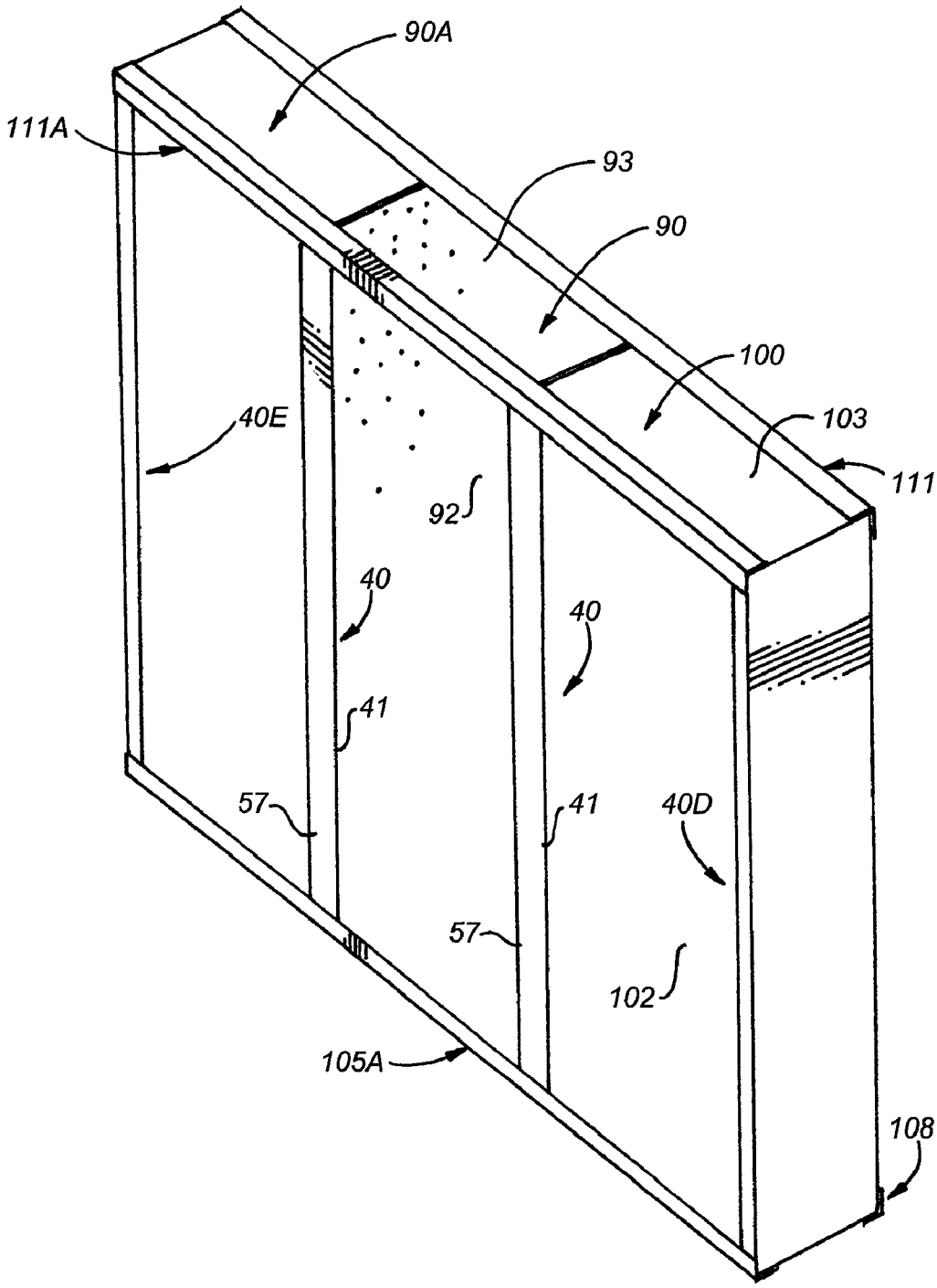

By way of example, and not limitation, during construction of a wall, a series of vertically oriented studs 40 is placed on eighteen inch centers. A foam panel 90, 100 about eighteen inches wide is placed between each adjacent pair of spaced apart flanges such that the first edge (for example, edge 94), i.e., the right hand edge, of a vertically oriented panel contacts the back 54B of the neck of one stud and the second edge (for example, edge 104), i.e., the left hand edge of a vertically oriented panel contacts the front of the neck of another stud. Consequently, as shown in FIG. 17, each foam panel is sandwiched between a pair of vertically oriented metal studs 40, 40D, 40E. Each stud 40, 40D, 40E runs along a vertically oriented edge 94, 104 of a foam panel. L-shaped support members 105A and 108 run along the bottom 105 of the foam panels and of the studs 40, 40D, 40E. Members 105A and 108 are riveted or otherwise fastened to each stud 40, 40D, 40E. Metal members 105A and 108 preferably do not contact each other. This prevents heat in the ambient air from being transmitted from member 108 to member 105A. A single U-shaped member can be utilized in place of members 105A and 108. Such a U-shaped member would span across the bottom 105 of each panel from the inside face 102 to the outside face 101 of the panel. The use of such a U-shaped member is discouraged, but not prohibited, because it facilitates the transmission of heat from the outside of the panel to the inside of the panel via the metal U-shaped member. Studs 40D, 40E are identical to stud 40 except that studs 40D, 40E each only have one pair 56-57 or 41-42 of flanges. In FIG. 17, the openings 43, 44, 48, etc formed through the neck of stud 40D are omitted for the sake of clarity.

A pair of U-shaped members 111, 111A (FIG. 17) also run along the top 103, 93 of the panels in the same manner that members 105A and 108 run along the bottom 105 of the panels. In the event that the top of a structural wall panel is sloped in the manner evidenced by surface 202 in FIG. 8, then members 111 and 111A take on a V-shape so they can conform to the top of the wall panel. The U-shaped (or V-shaped) members extending along the top of a wall panel are riveted or otherwise attached to each stud 40. At the end of each vertically oriented wall panel, the vertical edge of a foam panel is supported by a stud 40D, 40E that is C-shaped, i.e., that only includes one set of flanges 56, 57 and does not include the second set of flanges 41, 42. The second set of flanges is not necessary because the stud is at the end of the wall panel.

As can be seen, each wall panel of the type illustrated in FIGS. 6, 17 consists of foam panels supported by an interconnected metal frame work consisting of spaced apart, parallel, vertically oriented studs 40, 40D, 40E and horizontally oriented structural support members 105A, 108, 111, 111A extending along the top and bottom of the foam panels. This structure is unusually strong, particularly when the flanges of a stud are thicker than the neck of a stud and/or when the flanges are reinforced by bending metal over on itself, by forming strengthening ribs or detents in the flanges, by attaching a strip of metal to the flanges, or by otherwise strengthening the flanges.

Limiting the transfer of heat from the neck 54 of a metal stud 40 to the edge 104 of a foam panel 100 at the neck 54—edge 104 interface between neck 54 and edge 104 is critical in the practice of the invention. Heat transferred from the face 54A of neck 54 to edge 104 can travel through the inside portion of panel 100 indicated by arrows S in FIGS. 6 and 7 and can be transmitted at least in part into the inside of a residence or other building structure. As the cumulative area of openings formed in the neck 54 of a stud 40 increases, the ability of the neck 54 of stud 40 to transmit heat to edge 104 decreases. Openings formed in the neck 54 of a stud 40 are shown in dashed outline 48B, 48A, 43A, 44A in FIG. 7. The circular openings in neck 54 are omitted in FIG. 7 for the sake of clarity. The cumulative area of openings 48B, 48A, 43A, 44A (and any other openings formed through neck 54) is calculated in the manner earlier described. The rectangular surface area of edge 104 is calculated by multiplying the height of edge 104 by the width of edge 104. In order to limit the transmission of heat from neck 54 to edge 104, the ratio of the surface area of edge 104 to the cumulative area of openings 48B, 48A, 43A, 44A should be in the range of 10:1 to 1.33:1, preferably 5:1 to 1.33:1.

Figure 7:
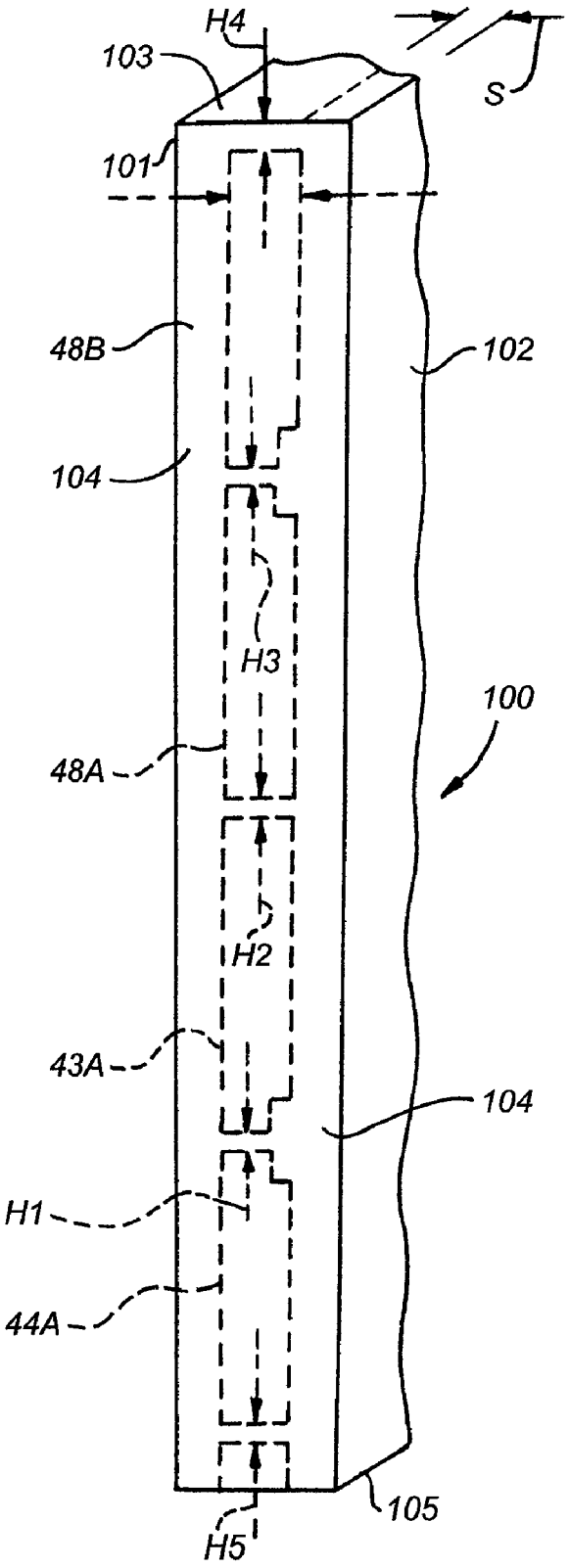
FIG. 7 is a perspective view illustrating a side or edge of a foam panel used in the invention and illustrating the mode of operation thereof.

Similarly, as the surface area of venturi bridges on the front (or back) of the neck 54 decreases, the ability of neck 54 to transmit heat to edge 104 decreases. The cumulative surface area of venturi bridges on the front 54A of neck 54 can be calculated in the manner earlier described. The ratio of the surface area of edge 104 to the cumulative surface area of the venturi bridges in neck 54 should be in the range of 25:1 to 4:1, preferably 25:1 to 10:1, to limit the transmission of heat from neck 54 to edge 104. In FIG. 7, the height of each venturi bridge is indicated by arrows H1, H2, H3, H4, H5, respectively. Each distance H1, H2, H3, H4, H5 is equal to the others.

FIGS. 12 to 15 illustrate a bracket 140 utilized to secure a wall panel to a concrete foundation 203, wood frame foundation, or other foundation. Bracket 140 includes a foot 141 with oblong aperture 143 formed therethrough. Bracket 140 also includes a rectangular body 142 normal to and depending from foot 141. During installation of a wall panel a plurality of brackets is attached to foundation 203 at desired intervals. These intervals preferably correspond to the intervals between the studs 40A in a wall panel. The brackets 140 are attached to foundation 203 by driving bolts through openings 143 into the foundation. Or, screws or other fasteners can be inserted through openings 143A. After the brackets 140 are attached to foundation 203, a wall panel is positioned on the brackets 140 in the manner illustrated in FIG. 15 and the brackets 140 are riveted or otherwise secured to member 105A and/or studs 40A.

Figure 5:
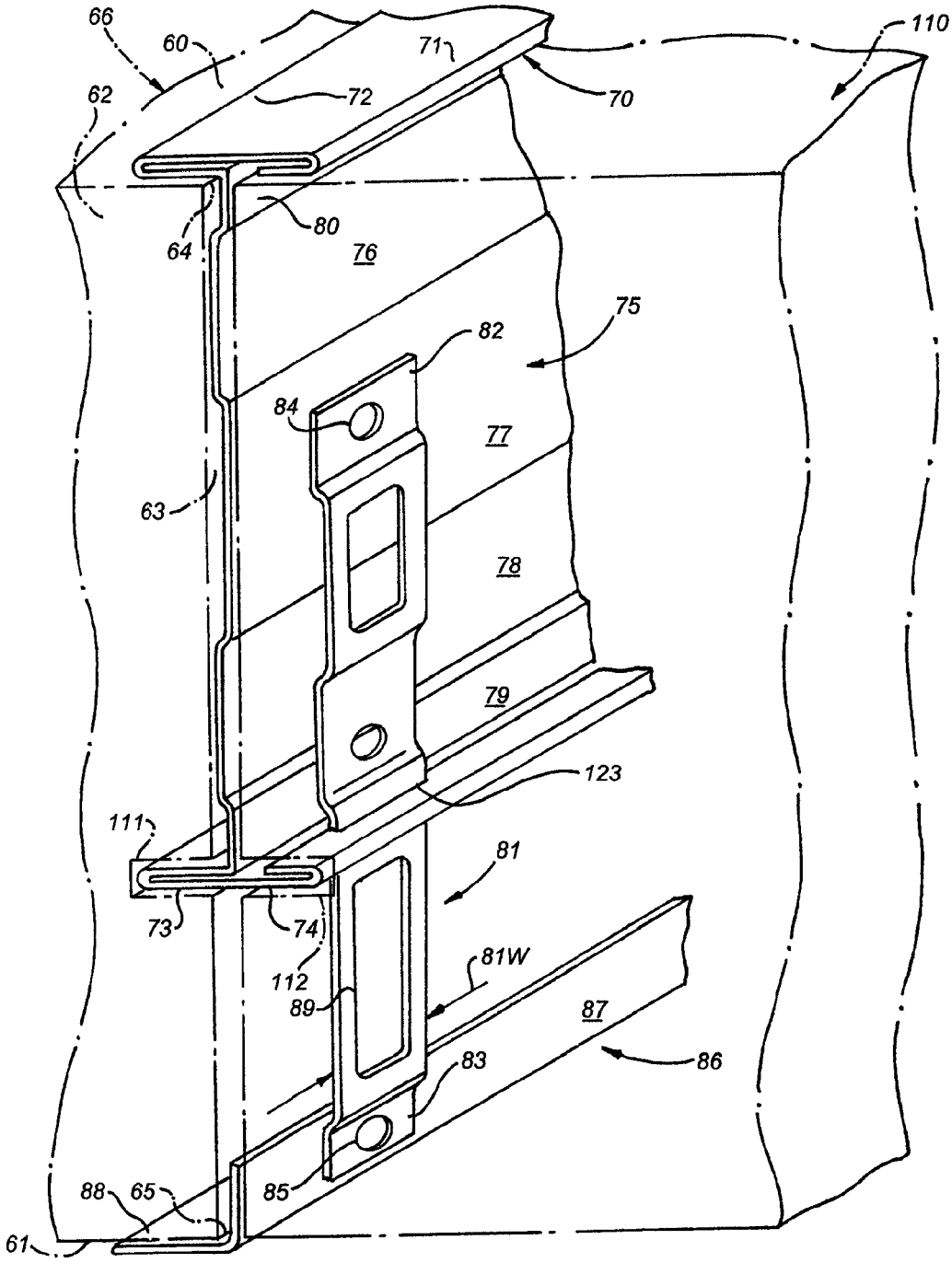
FIG. 5 is a perspective view illustrating construction details of a structural panel used in the wall or roof of a building structure.
Figure 16:
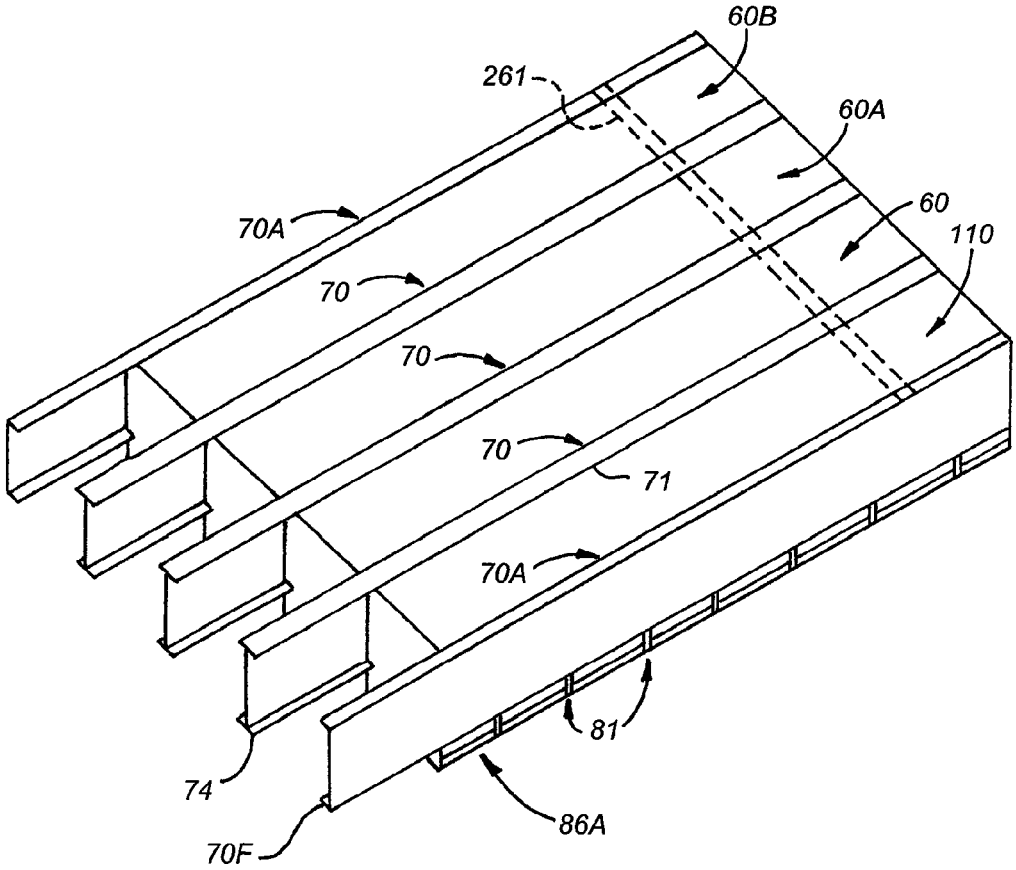
FIG. 16 is a perspective view illustrating a roof panel construction in accordance with the invention; and, FIG. 17 is a perspective view illustrating a wall panel construction in accordance with the invention.

FIG. 16 illustrates a roof panel constructed utilizing metal studs and panels of the type shown in FIG. 5. The panel in FIG. 16 includes I-studs 70 and C-studs 70A. Foam panels 60, 60A, 60B, and 110 are supported intermediate the studs. L-shaped member 86A (identical to member 86) is secured to stud 70A by members 81. Each member 81 is riveted or otherwise attached at one end to member 86A and at the other end to stud 70A. The flange 70F of stud 70A has spaced apart openings cut therethrough comparable to opening 123 (FIG. 5) such that a member 81 can slidably extend through the opening in flange 70F in the same manner that member 81 extends through opening 123 in FIG. 5. Elongate metal support members 261 can be riveted or otherwise connected to studs 70, 70A to hold the studs together in spaced apart relationship.

The studs 10, 30, 40, 40A, 70 utilized in the practice of the invention are preferably fabricated from metal, but can be fabricated from any desired material. When metal is utilized it has a thermal conductivity greater than 0.030 g-cal/(sec.)(sq. cm.)(degree C./cm.) at eighteen degrees Centigrade. The preferred metal is steel. The construction of the invention, including flanges 71, 72, 73, 74 that are each formed by folding the edge of a panel over on itself, enables lightweight 20 gauge steel panels to be utilized to roll and form studs 10, 20, 40, 40A, 70 from a flat panel of steel. The ability to use such a thin gauge of metal reduces the cost of constructing the panels of the invention.

FIG. 17 illustrates a wall panel constructed utilizing metal studs and panels of the type shown in FIG. 6. The panel in FIG. 17 includes I-studs 40 (i.e., with a cross-sectional area in the shape of an I) and C-studs 40D (i.e., with a cross-sectional area in the shape of a C). Foam panels 100, 90, 90A are supported intermediate the studs. L-shaped support members 111A and 111 extend along the top of the foam panels and are riveted or otherwise connected to the tops of the metal studs. L-shaped support members 105A and 108 extend along the bottom of the foam panels and are riveted or otherwise connected to the bottoms of the metal studs. Openings for window or doors can be formed in wall panels. Channels can be cut in the wall panels for electrical wiring, plumbing, etc.

In use, wall panels of the type illustrated in FIGS. 6 and 17 (or of the type illustrated in FIG. 5) are constructed. Roof panels of the type illustrated in FIGS. 5 and 16 (or of the type illustrated in FIG. 6) are constructed. The roof and wall panels are transported to a construction site. Brackets 140 are mounted on the foundation 203 around the periphery of the foundation at spaced apart intervals in the manner illustrated in FIG. 15. The wall panels are then positioned along the periphery of the foundation. Bottom portions of each panel are secured to body 142 of each bracket 140 in the manner illustrated in FIG. 15. A cross-beam 132 or other support is positioned with supports that extend to the walls or to the foundation. Roof panels are mounted on the top of the wall panels and of the cross-beam 132 in the general manner illustrated in FIGS. 8 and 10 to insure a thermal seal is formed between the roof panels and top of the wall panels.

If desired, once a wall panel of the type shown in FIG. 17 is constructed, sheet rock or plywood or other material can be attached to the flanges of the metal studs before the wall panel is transported to a construction site to erect a residence or other building structure. Such paneling or other material can also be attached to the metal studs in the wall panel after the panel is transported to a construction site at which a building structure is erected. Similarly, plywood or other material can be attached to roof panels of the type shown in FIG. 16 before or after the panels are transported to a construction site to assemble a building structure. When sheet rock or other finishing materials are mounted on a wall or roof panel before the panels are transported to a construction site, the erection at the site of outer walls and roof of a one story or multi-story building structure can be accomplished in a day or less.

The foam used in panel 60, 90, 100, etc. can vary as desired, but expanded polystyrene foam panels are presently preferred, in part because they are lightweight and do not exude harmful chemicals.

Panels constructed in accordance with the invention can be utilized to construct flat or sloped roofs. Sloped roofs usually have a slope of at least 2/12.

Having described the presently preferred embodiments and best mode of the invention in such terms as to enable those of skill in the art to understand and practice the invention, we claim:

1. A structural panel for a building, comprising:

a plurality of I-beam stud members, each I-beam stud member being made of metal and having first and second flanges separated by a face which runs an entire length of each I-beam stud member, the first and second flanges having a thickness at least twice a thickness of the face, the first and second flanges being parallel to each other and perpendicular to the face, each I-beam stud member having a plurality of polygonal openings through the face separated only by venturi bridges, the polygonal openings having a first width in a first region of the polygonal opening and a second width in a second region of the polygonal opening, the first width being greater than the second width, each I-beam stud member further having a plurality of circular openings through the face adjacent to the second width of the polygonal openings, at least one of the venturi bridges having a raised area extending above the face, the plurality of polygonal openings blocking thermal conduction between the first and second flanges such that thermal conduction between the first and second flanges occurs only through the venturi bridges for the entire length of each I-beam stud member, the face having an area in the range of 1.33 to 5 times a cumulative area of the plurality of polygonal openings and in the range of 10 to 25 times a cumulative area of the venturi bridges to reduce thermal conduction between the first and second flanges; and an insulating foam material disposed between the plurality of I-beam stud members, the insulating foam material being in contact with the face of the I-beam stud members.

2. The structural panel of claim 1, wherein the I-beam stud members and insulating foam material constitute a wall panel for the building.

3. The structural panel of claim 1, wherein the I-beam stud members and insulating foam material constitute a roof panel for the building.

4. The structural panel of claim 3, wherein the roof panel extends over a portion of the wall panel for providing a thermal seal between the roof and wall interconnection.

5. The structural panel of claim 3, wherein the roof panel includes:

a plurality of structural arms extending from the first flange of the I-beam stud member; and a support member connected to the plurality of structural arms for hanging an interior portion of the roof panel.

6. The structural panel of claim 5, wherein the plurality of structural arms each includes an opening for reducing thermal conduction.

7. The structural panel of claim 1, further including brackets connected to a bottom portion of the structural panel for attaching to a foundation.

8. A structural panel for a building, comprising:

a plurality of I-beam stud members, each I-beam stud member being made of metal and having first and second flanges separated by a face, the first and second flanges having a thickness at least twice a thickness of the face, the first and second flanges being parallel to each other and perpendicular to the face, each I-beam stud member having a plurality of openings through the face separated by venturi bridges, each I-beam stud member further having a plurality of circular openings through the face, at least one of the venturi bridges having a raised area extending above the face, the plurality of openings blocking thermal conduction between the first and second flanges such that thermal conduction between the first and second flanges occurs through the venturi bridges, the face having an area in the range of 1.33 to 5 times a cumulative area of the plurality of openings and in the range of 10 to 25 times a cumulative area of the venturi bridges to reduce thermal conduction between the first and second flanges; and an insulating foam material disposed between the plurality of I-beam stud members, the insulating foam material being in contact with the face of the I-beam stud members.

9. The structural panel of claim 8, wherein the I-beam stud members and insulating foam material constitute a wall panel for the building.

10. The structural panel of claim 8, wherein the I-beam stud members and insulating foam material constitute a roof panel for the building.

11. The structural panel of claim 10, wherein roof panel extends over a portion of the wall panel for providing a thermal seal between the roof and wall interconnection.

12. The structural panel of claim 10, wherein the roof panel includes:

a plurality of structural arms extending from the first flange of the I-beam stud member; and a support member connected to the plurality of structural arms for hanging an interior portion of the roof panel.

13. A building, comprising:

a wall panel;

a roof panel extending over a portion of the wall panel for providing a thermal seal between the roof and wall interconnection, wherein the wall panel and roof panel each include, (a) a plurality of I-beam stud members, each I-beam stud member being made of metal and having first and second flanges separated by a face, the first and second flanges being parallel to each other and perpendicular to the face, each I-beam stud member having a plurality of openings through the face separated by venturi bridges, the plurality of openings blocking thermal conduction between the first and second flanges such that thermal conduction between the first and second flanges occurs through the venturi bridges, the face having an area in the range of 1.33 to 5 times a cumulative area of the plurality of openings and in the range of 10 to 25 times a cumulative area of the venturi bridges to reduce thermal conduction between the first and second flanges, and (b) an insulating foam material disposed between the plurality of I-beam stud members, the insulating foam material being in contact with the face of the I-beam stud members.

14. The structural panel of claim 13, wherein the face has a second plurality of openings adapted for passing conduit or wire between the plurality of I-beam stud members.

15. The structural panel of claim 13, wherein the roof panel includes:

a plurality of structural arms extending from the first flange of the I-beam stud member; and a support member connected to the plurality of structural arms for hanging an interior portion of the roof panel.

16. The structural panel of claim 13, further including a bracket for connecting the roof panel to the wall panel.

17. A method of making a structural panel for a building, comprising:

providing a plurality of I-beam stud members, each I-beam stud member being made of metal and having first and second flanges separated by a face, the first and second flanges being parallel to each other and perpendicular to the face, each I-beam stud member having a plurality of openings through the face separated by venturi bridges, the plurality of openings blocking thermal conduction between the first and second flanges such that thermal conduction between the first and second flanges occurs through the venturi bridges, the face having an area in the range of 1.33 to 5 times a cumulative area of the plurality of openings and in the range of 10 to 25 times a cumulative area of the venturi bridges to reduce thermal conduction between the first and second flanges; and disposing an insulating material between the plurality of I-beam stud members, the insulating material being in contact with the face of the I-beam stud members.

18. The method of claim 17, wherein the I-beam stud members and insulating foam material constitute a wall panel for the building.

19. The method of claim 18, wherein the I-beam stud members and insulating foam material constitute a roof panel for the building.

20. The method of claim 19, wherein the roof panel extends over a portion of the wall panel for providing a thermal seal between the roof and wall interconnection.

21. The method of claim 19, wherein the roof panel includes:

providing a plurality of structural arms extending from the first flange of the I-beam stud member; and providing a support member connected to the plurality of structural arms for hanging an interior portion of the roof panel.

22. The method of claim 17, wherein the face has a second plurality of openings adapted for passing conduit or wire between the plurality of I-beam stud members.

* * * * *